US011280055B1

(12) United States Patent
Huang et al.

(10) Patent No.: US 11,280,055 B1
(45) Date of Patent: Mar. 22, 2022

(54) CONSTRUCTION DEVICE AND METHOD FOR LATERAL BRACING IN ULTRA-DEEP FOUNDATION PIT WITH SILT

(71) Applicant: CHINA CONSTRUCTION THIRD BUREAU FIRST ENGINEERING CO., LTD., Wuhan (CN)

(72) Inventors: Zhenghong Huang, Wuhan (CN); Bo Gao, Wuhan (CN); Xiaojun Zhang, Wuhan (CN); Yecun Qian, Wuhan (CN); Yunfeng Chen, Wuhan (CN); Shijie Liu, Wuhan (CN); Cang Chen, Wuhan (CN); Huamin Cheng, Wuhan (CN)

(73) Assignee: CHINA CONSTRUCTION THIRD BUREAU FIRST ENGINEERING CO., LTD., Wuhan (CN)

( * ) Notice: Subject to any disclaimer, the term of this patent is extended or adjusted under 35 U.S.C. 154(b) by 0 days.

(21) Appl. No.: 17/401,359

(22) Filed: Aug. 13, 2021

(30) Foreign Application Priority Data

Oct. 14, 2020 (CN) ..... 202011098680.7

(51) Int. Cl.
*E02D 17/04* (2006.01)

(52) U.S. Cl.
CPC ..... *E02D 17/04* (2013.01); *E02D 2200/1642* (2013.01); *E02D 2300/0029* (2013.01); *E02D 2600/20* (2013.01)

(58) Field of Classification Search
CPC . E02D 17/04; E02D 17/08; E02D 2200/1642; E02D 2300/0029; E02D 2600/20
See application file for complete search history.

(56) References Cited

U.S. PATENT DOCUMENTS 2,474,803 A * 6/1949 Putnam ..... E21D 1/03
2008/0219777 A1* 9/2008 Thompson ..... E02D 17/086

FOREIGN PATENT DOCUMENTS

JP H05132939 A 5/1993
JP H05331856 A 12/1993

OTHER PUBLICATIONS

First Office Action from China patent office in a counterpart Chinese patent Application 202011098680.7, dated Mar. 29, 2021 (3 pages).

* cited by examiner

*Primary Examiner* — Carib A Oquendo

(57) ABSTRACT

A construction device and method for a lateral bracing in an ultra-deep foundation pit with silt includes a first-layer lateral bracing member, a plurality of suspension rope systems and construction operation plates. The first-layer lateral bracing member is connected with the enclosing structure of the foundation pit. The suspension rope systems include saddles, slings and joists. The saddles are connected with the first-layer lateral bracing member, and the construction operation plates are connected with the joists.

5 Claims, 7 Drawing Sheets

CONSTRUCTION DEVICE AND METHOD FOR LATERAL BRACING IN ULTRA-DEEP FOUNDATION PIT WITH SILT

FIELD

The present disclosure relates to buildings, in particular to a construction device and method for a lateral bracing in an ultra-deep foundation pit with silt.

BACKGROUND

With the increasing construction of urban infrastructure, it has been developed towards "deep underground", particularly, in coastal cities under high-speed development. A foundation pit serves as a connecting channel for ground and underground construction processes, and its deformation and stability directly affect the safety of the foundation pit and underground construction, and the construction quality of a lateral bracing in the foundation pit directly affects the deformation and the stability during excavation of the foundation pit and after the excavation of the foundation pit is completed. The construction of a traditional reinforced concrete lateral bracing generally includes first pretreating the ground under a to-be-constructed lateral bracing; then, pouring an under layer; and finally, binding reinforcements, building a mold and pouring concrete. This construction process is suitable for a foundation pit in which the soil body bearing capacity is relatively high, or the soil body bearing capacity is not high enough, but a soil body may be treated by adopting relevant reinforcement measures. However, the construction process is not suitable for an ultra-deep foundation pit with a relatively thick silt layer in a coastal zone.

DETAILED DESCRIPTION OF EMBODIMENTS

Figure 1:
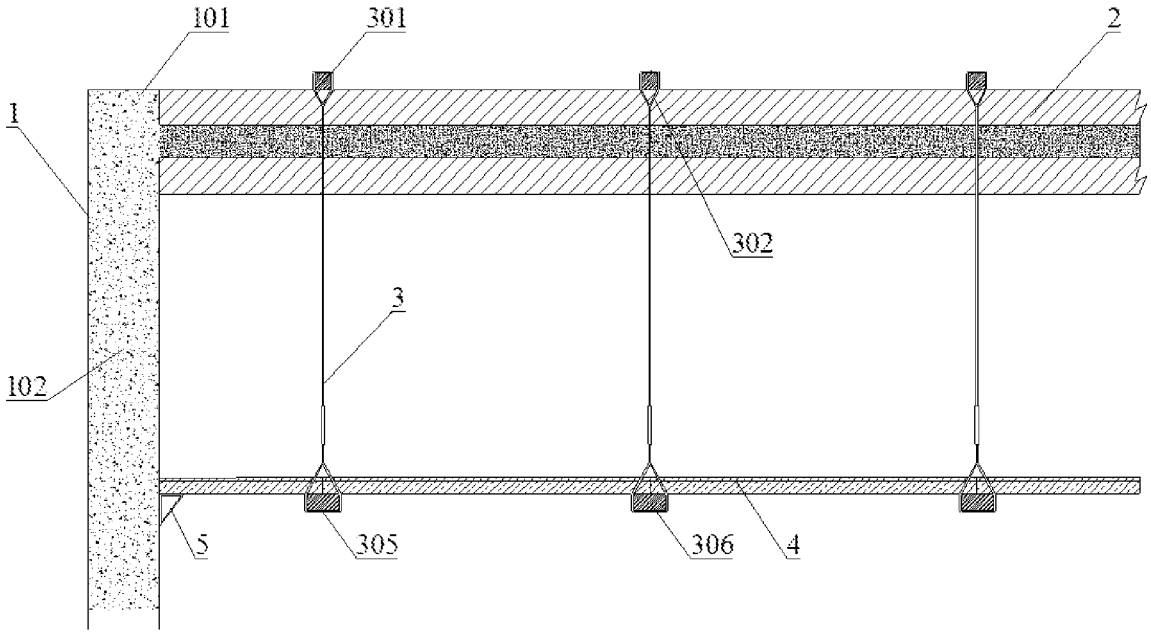
FIG. 1 is a schematic diagram showing a structure of a construction device for a lateral bracing in an ultra-deep foundation pit with silt according to the present disclosure.
Figure 2:
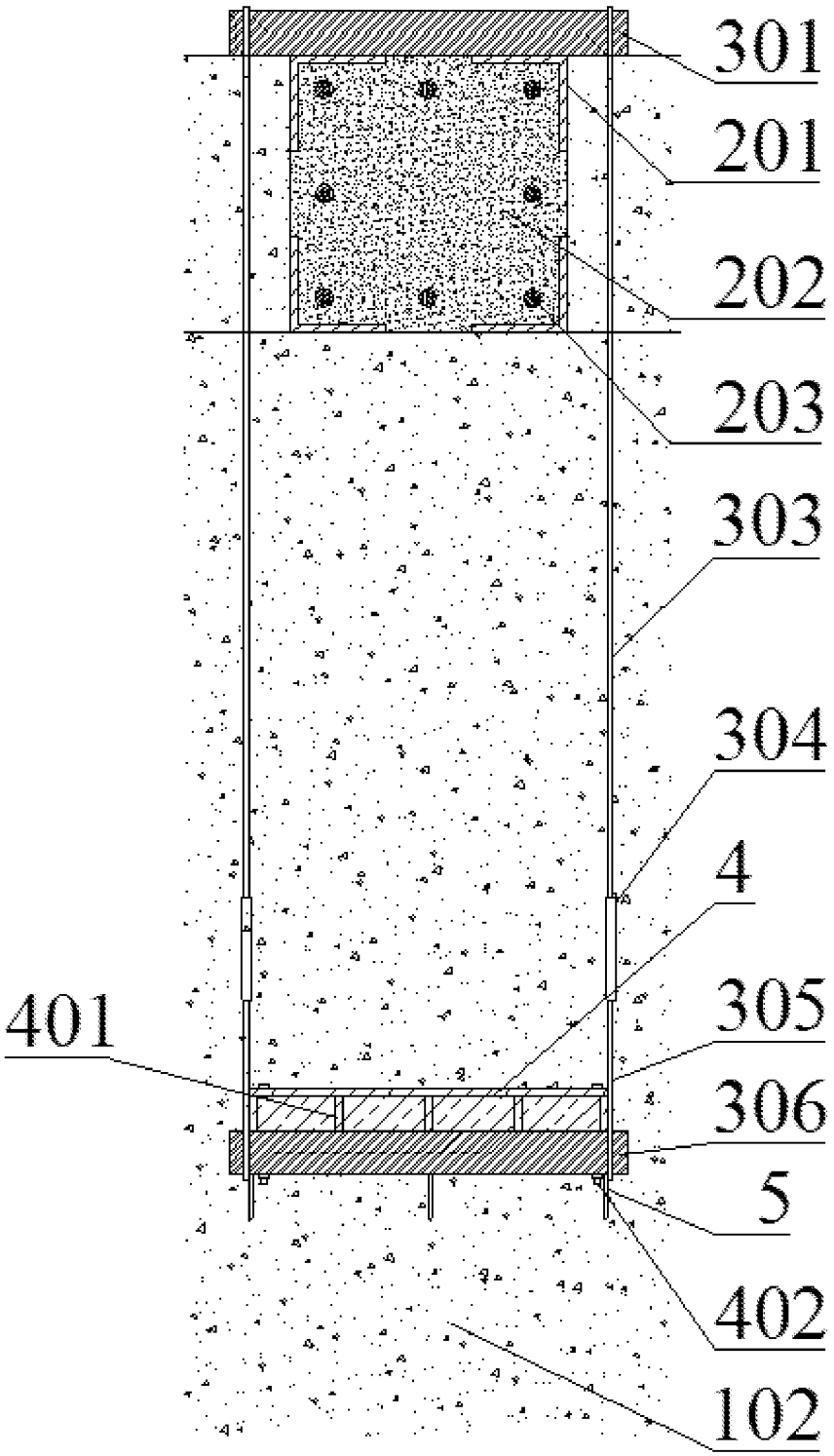
FIG. 2 is a schematic right view showing the structure in FIG. 1.
Figure 3:
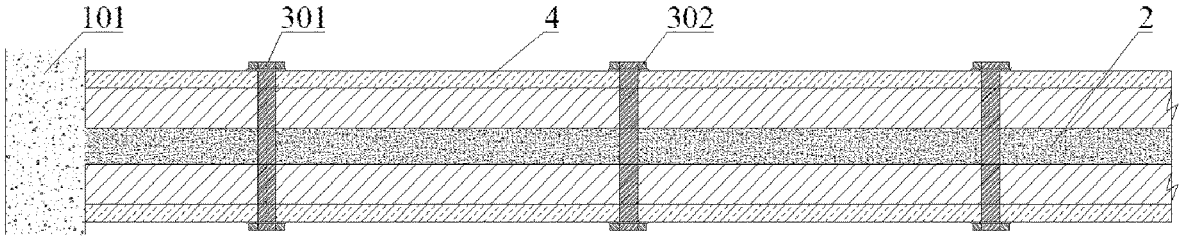
FIG. 3 is a schematic top view showing the structure in FIG. 1.
Figure 4:
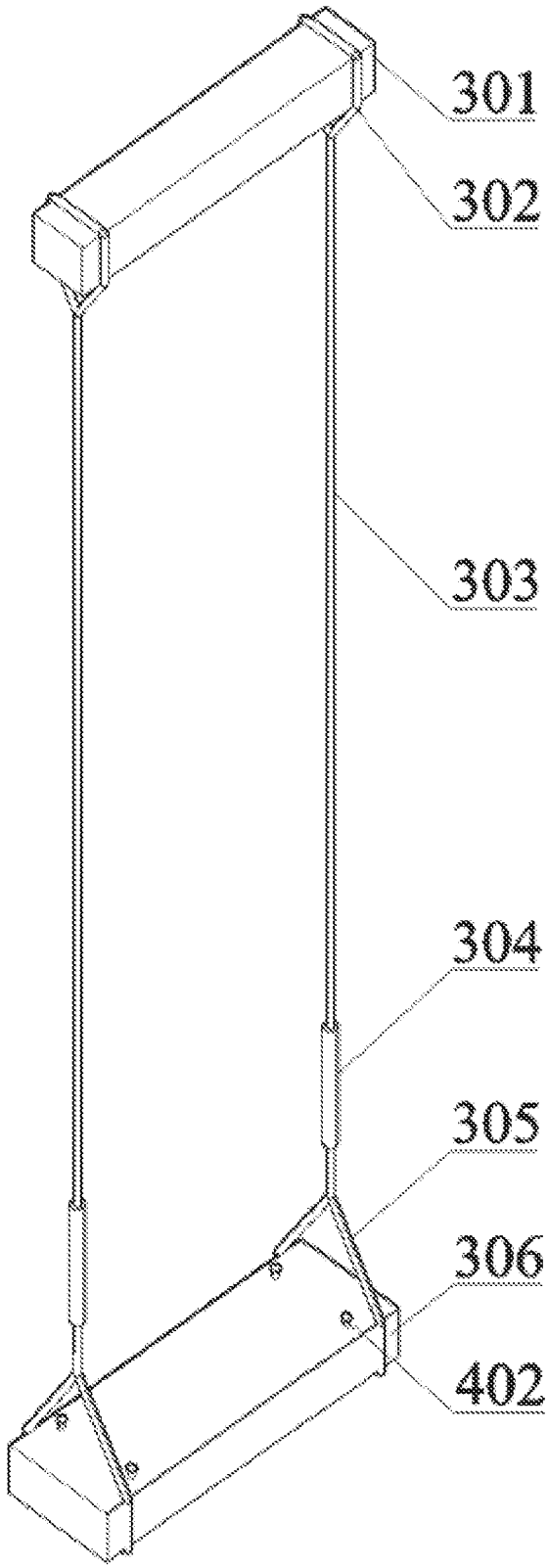
FIG. 4 is a schematic perspective view showing a structure of a suspension rope system in FIG. 1.
Figure 5:
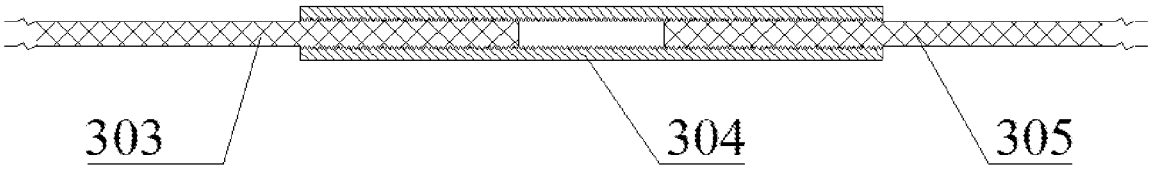
FIG. 5 is a schematic partial lateral-sectional view showing a structure of a length regulating member in FIG. 4.

The present disclosure will be further described in detail with reference to the accompanying drawings and specific embodiments.

As shown in FIG. 1 to FIG. 10, a construction device for a lateral bracing in an ultra-deep foundation pit with silt includes a first-layer lateral bracing member 2, construction operation plates 4 and a plurality of suspension rope systems 3. The ultra-deep refers to a foundation pit of more than 15 meters deep in present disclosure.

The first-layer lateral bracing member 2 is connected with an enclosing structure 1 of the foundation pit. The plurality of suspension rope systems 3 are arranged along a long axis direction of the first-layer lateral bracing member 2.

Specifically, the enclosing structure 1 of the foundation pit includes a firstly poured grouting pile or diaphragm wall 102 and a post poured capping beam 101. Of course, the enclosing structure 1 may also be of other structures of the foundation pit.

The first-layer lateral bracing member 2 in the present embodiment includes a reinforcement cage 203, angle steels 201 and concrete layer 202 filled in the reinforcement cage 203. The angle steels 201 are connected with two sides of the enclosing structure 1. The reinforcement cages 203 are connected with the angle steels 201.

A first-layer lateral bracing system is formed by the first-layer lateral bracing member 2, which may not only be used as a first lateral bracing of the enclosing structure 1 in the foundation pit, but also may be used for bearing a load applied by the suspension rope systems 3 and the construction operation plates 4. And therefore, it is unnecessary to arrange a bearing device for the suspension rope systems 3. The angle steels 201 may be used for improving the bending resistance of the first-layer lateral bracing system. The reinforcement cages 203 and the angle steels 201 are welded connected, so that the integrality of the first-layer lateral bracing member 2 is improved, and the bearing capacity of the first-layer lateral bracing member 2 is improved.

Specific construction steps of the first-layer lateral bracing member 2 in the present embodiment are that: a position of the first-layer lateral bracing member 2 is determined, a soil body in a foundation pit below the first-layer lateral bracing member 2 is pretreated, an under layer is constructed as required, and a precamber is set. The angle steels 201 in the present embodiment include upper angle steels 201 and lower angle steels 201. Firstly, the lower angle steels 201 are set to be connected with the capping beam 101. Then, the reinforcement cages 203 are assembled on the lower angle steels 201. Next, the upper angle steels 201 are arranged, and the upper angle steels 201, the lower angle steels 201 and the reinforcement cages 203 are connected. And after the inspection is passed, concrete is poured to form the concrete layer 202. In the present embodiment, an arrangement direction of the first-layer lateral bracing member 2 is parallel to an arrangement direction of a lateral bracing in a foundation pit to be constructed later. The first-layer lateral bracing member 2 may also be of other bracing structures, but is not limited to the lateral bracing in the foundation pit, and may also be other lateral arms or trusses arranged above the foundation pit.

The suspension rope systems 3 include saddles 301, slings 303, joists 306, upper fixing members 302, lower fixing members 305 and length regulating members 304. The saddles 301 are connected with the first-layer lateral bracing member 2. The joists 306 are arranged below the saddles 301 at intervals. The joists 306 are connected with the saddles 301 or the first-layer lateral bracing member 2 by the slings 303.

Specifically, the upper fixing members 302 are connected with the saddles 301. The lower fixing members 305 are connected with the joists 306. Upper ends of the slings 303 are directly connected with the upper fixing members 302, or the upper ends of the slings 303 are connected with the upper fixing members 302 by the length regulating members 304. Lower ends of the slings 303 are connected with the lower fixing members 305 by the length regulating members 304, or the lower ends of the slings 303 are directly connected with the lower fixing members 305. In the present embodiment, preferably, the upper ends of the slings 303 are directly connected with the upper fixing members 302, and the lower ends of the slings 303 are connected with the lower fixing members 305 by the length regulating members 304.

In the present embodiment, the length regulating members 304 are preferably threaded pipe fittings. The lower ends of the slings 303 and the lower fixing members 305 are provided with threaded sections matched with the threaded pipe fittings. By using the length regulating members 304, not only may the relative distances between the saddles 301 and the joists 306 and the heights of the joists 306 be regulated, but also a space may be provided for the disassembly and assembly of the construction operation plates 4.

In the present embodiment, each of the suspension rope systems 3 includes two lower fixing members 305 symmetrically arranged at two sides of each of the joists 306; and at least one of the lower fixing members 305 is detachably connected with the joist 306 or the slings 303. The number of the upper fixing members 302 corresponds to that of the lower fixing members 305, and arrangement positions of the upper fixing members 302 and the lower fixing members 305 are symmetric. In the present embodiment, each of the suspension rope systems 3 includes a saddle 301 and a joist 306 and further includes two slings 303, an upper fixing member 302, a lower fixing member 305 and a length regulating member 304.

Figure 6:
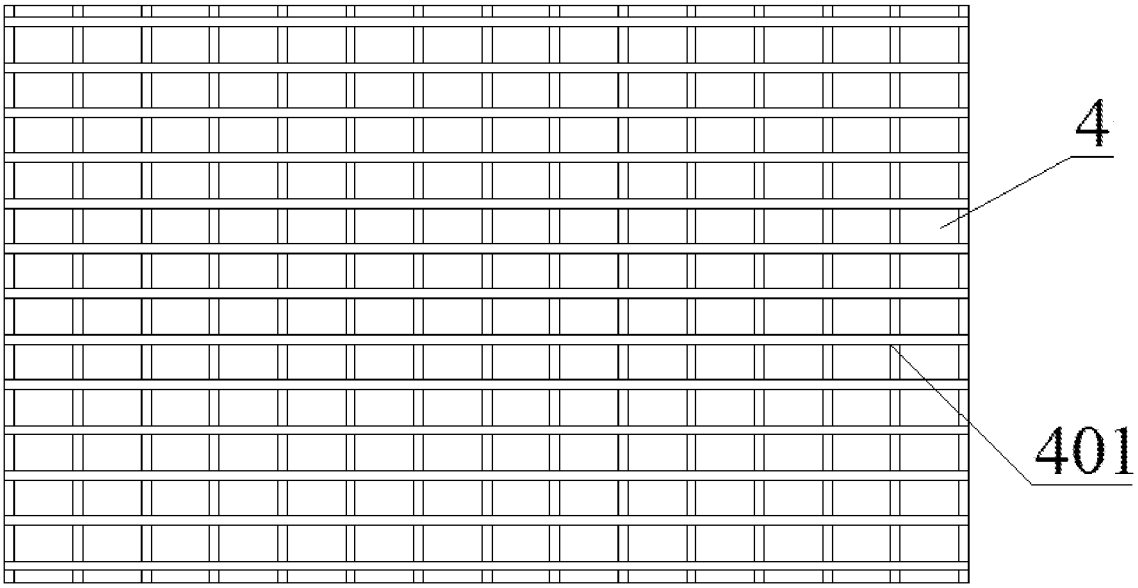
FIG. 6 is a schematic bottom view showing a structure where construction operation plates are provided with stiffened plates in FIG. 1.

As shown in FIG. 6, the construction operation plates 4 are provided with stiffened plates 401. The construction operation plates 4 are preferably steel plates, and the stiffened plates 401 and the construction operation plates 4 are welded to form a whole. The stiffened plates 401 are welded and fixed in a grid shape to lower surfaces of the construction operation plates 4.

Figure 7:
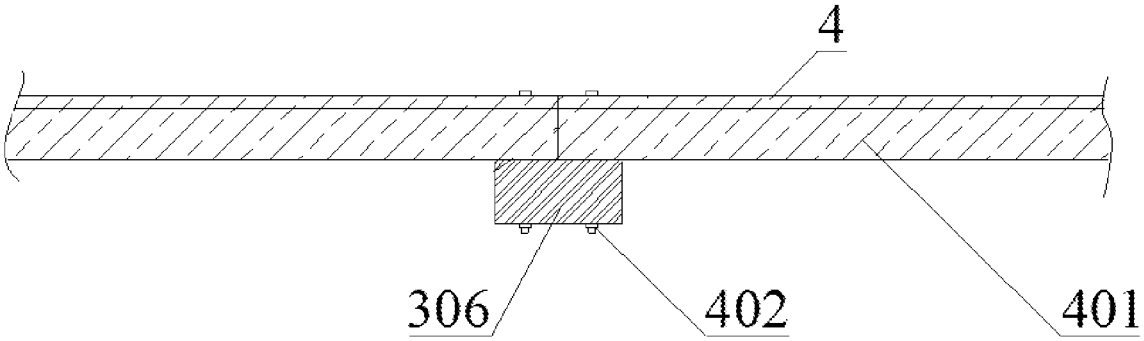
FIG. 7 is a schematic enlarged view showing a structure that two construction operation plates are matched with a joist in FIG. 1.
Figure 8:
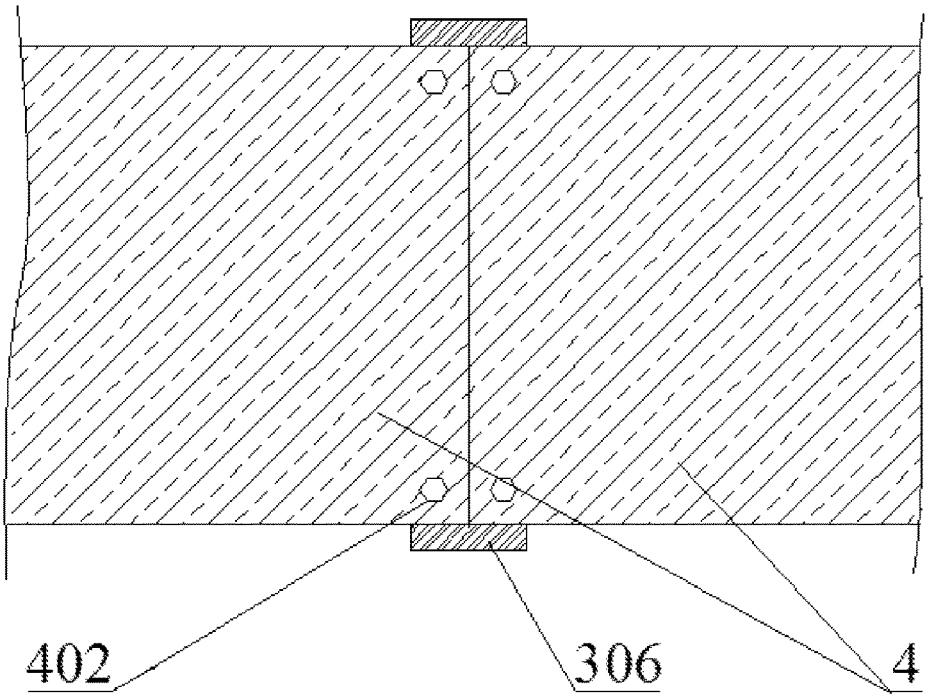
FIG. 8 is a schematic top view showing a structure in FIG. 7.
Figure 9:
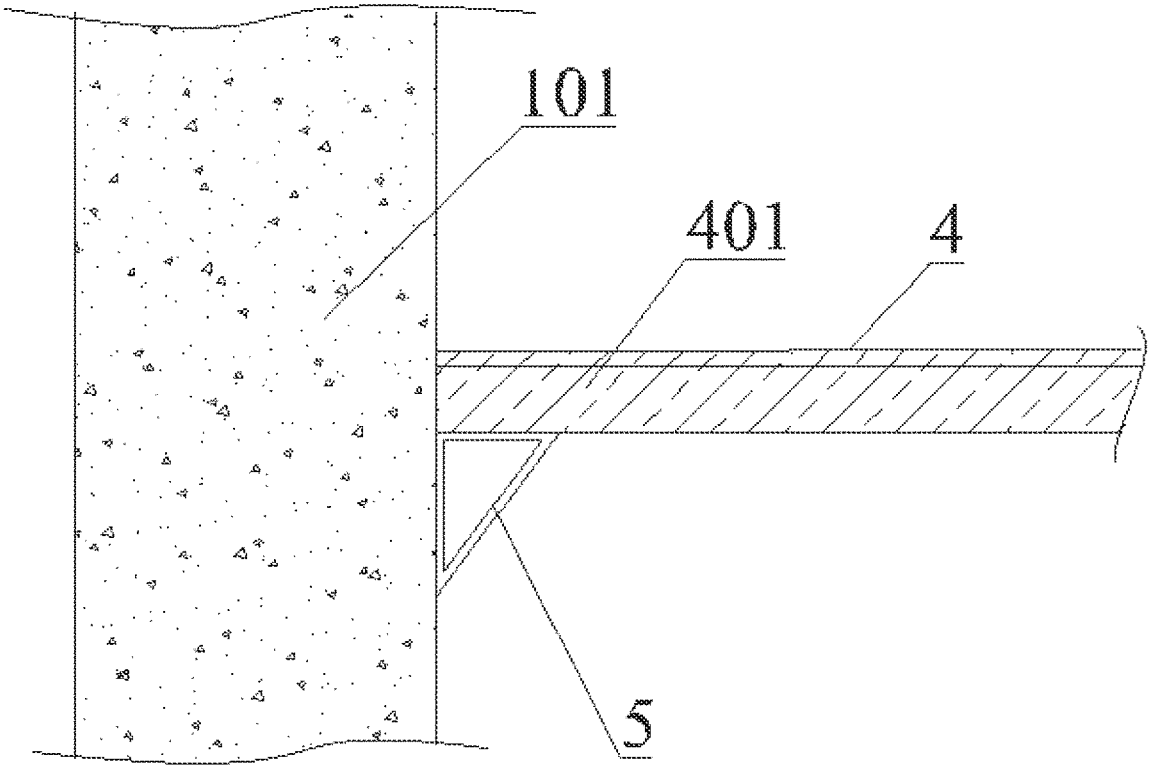
FIG. 9 is a schematic partially-enlarged view showing a structure at a diagonal bracing in FIG. 1.

As shown in FIG. 7 and FIG. 8, the construction operation plates 4 are connected with the joists 306. There may be several construction operation plates 4, however, for facilitating disassembly and assembly, it is preferable to have a plurality of the construction operation plates 4, and each of the construction operation plates 4 is connected with at least two of the joists 306. In the present embodiment, preferably, a connecting seam of the two adjacent construction operation plates 4 is located at the upper end of the same joist 306. Specifically, two ends of each of the construction operation plates 4 are respectively arranged on the two adjacent joists 306 and are connected by connecting bolts 402, and each of the joists 306 is provided with end parts of the two adjacent construction operation plates 4. As shown in FIG. 9, the construction operation plates 4 located at the two outermost ends are connected with the firstly poured grouting pile or diaphragm wall 102, and in the present embodiment, diagonal bracings 5 are arranged below end parts of the construction operation plates 4 connected with the grouting pile or diaphragm wall 102. In the present embodiment, the diagonal bracings 5 are used for bearing loads at the end parts of the construction operation plates 4 and fixing the end parts of the construction operation plates 4. Of course, the diagonal bracings 5 may also be arranged at two ends of the first-layer lateral bracing member 2 and are connected with the joists 306. Or the diagonal bracings 5 may also be connected with the end parts of the joists 306 and the lower ends of the construction operation plates 4 so as to improve the stability of connections between the construction operation plates 4 and the joists 306.

Figure 10:
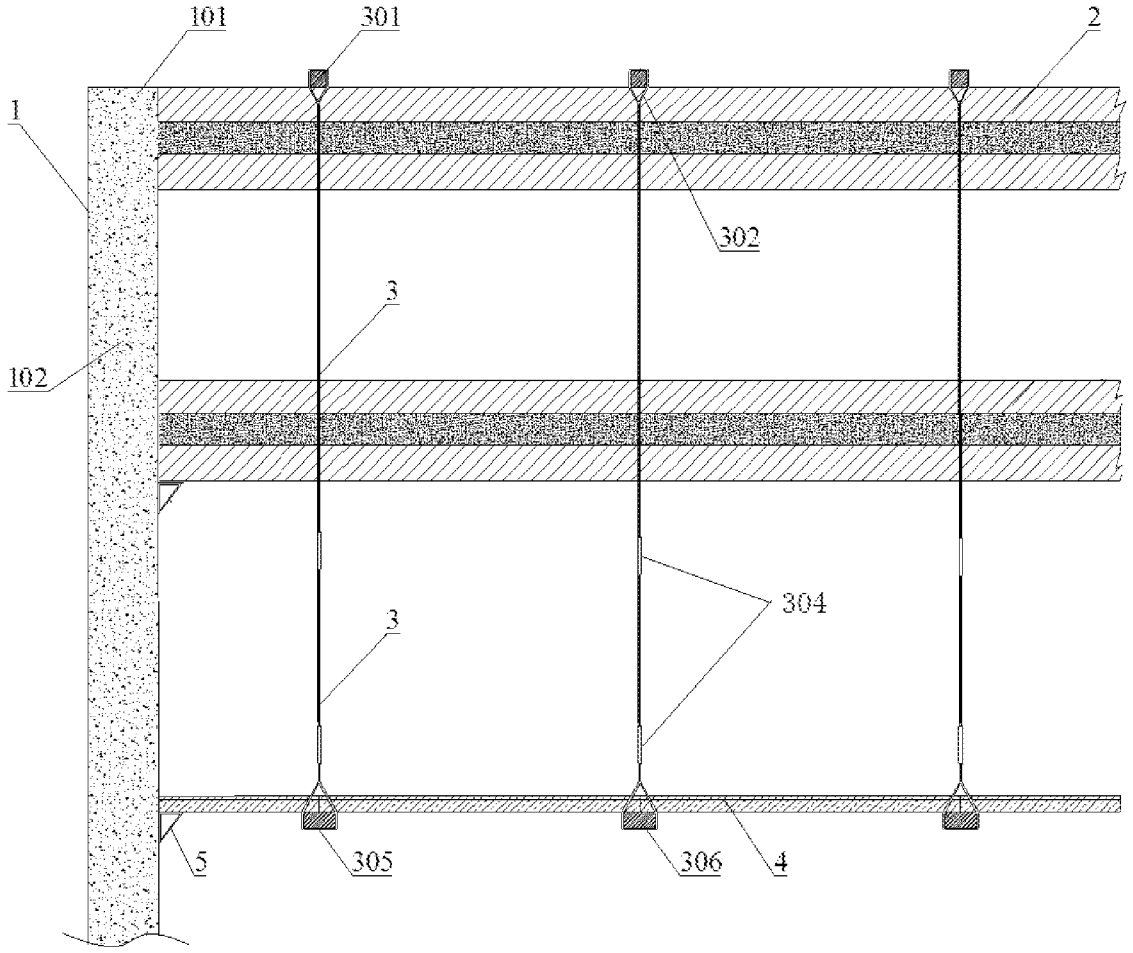
FIG. 10 is a schematic diagram showing a structure that the construction device in FIG. 1 performs construction of a lateral bracing on the next layer.

A construction method for a lateral bracing by using the construction device for the lateral bracing in the ultra-deep foundation pit with silt in the present embodiment includes the following steps:

step 1: an enclosing structure 1 in a foundation pit and a first-layer lateral bracing member 2 are constructed, wherein the enclosing structure 1 includes a grouting pile or diaphragm wall and a capping beam, and the first-layer lateral bracing member 2 is formed by pouring concrete after binding reinforcement cages and angle steels;

step 2: the number and positions of saddles 301 of suspension rope systems are determined according to the length of the first-layer lateral bracing member, and the plurality of saddles 301 are uniformly fixed to the first-layer lateral bracing member 2 at intervals; and then, an upper fixing member 302 is mounted at each of two sides of each of the saddles 301;

step 3: positions of diagonal bracings 5 are determined according to the height of a to-be-constructed lateral bracing, and the diagonal bracings 5 are mounted on the enclosing structure; the length of sling 303 is determined according to the position of the to-be-constructed lateral bracing, upper ends of the slings 303 are connected with the upper fixing members 302; the number and positions of construction operation plates 4 and the length of each of the construction operation plates 4 are determined according to the number and positions of the saddles 301, all the construction operation plates 4 are connected into a whole by virtue of joists 306 and connecting bolts 402, then, the construction operation plates 4 connected into a whole are suspended and transferred to the position of the to-be-constructed lateral bracing, and two ends of the construction operation plates 4 connected into a whole are enabled to be fixed together with the diagonal bracings 5, wherein positions and number of the joists 306 correspond to those of the saddles 301; a lower fixing member 305 is mounted at each of two sides of each of the joists 306, length regulating members 304 are mounted on the lower fixing members 305, and then, the length regulating members 304 are connected with lower ends of the slings 303 in step 4: and trial hoisting is performed, and relevant hoisting parameters are determined, wherein the hoisting parameters include weight parameters of the to-be-constructed lateral bracing;

step 4: after trial hoisting is completed, reinforcements of the to-be-constructed lateral bracing are arranged on the construction operation plates 4, and the reinforcements are bound to form reinforcement cages of the to-be-constructed lateral bracing; when the reinforcements of the to-be-constructed lateral bracing are arranged on the construction operation plates 4, it is possible to disassemble parts of length regulating members 304 and lower fixing members 305 of the construction operation plates 4 so as to put in the reinforcements of the to-be-constructed lateral bracing, and after the reinforcements of the to-be-constructed lateral bracing are put in, the disassembled length regulating members 304 and lower fixing members 305 are connected; side formworks are mounted on all side ends of the reinforcement cages of to-be-constructed lateral bracing on the construction operation plates 4 to form a pouring cavity of the to-be-constructed lateral bracing; heights and levelness of the construction operation plates 4 are regulated by virtue of the height regulating members 304, and a precamber is set, of course, the heights and levelness of the construction operation plates 4 may also be regulated by lengthening members, the lengthening members in the present embodiment may be another sling or more other slings which may be bolted, bound or welded; concrete is poured in the pouring cavity, after the strength of the concrete reaches the standard or meets a design requirement, the side formworks are removed, and concrete curing is performed, and thus, the construction of the lateral bracing on this layer is completed, as shown in FIG. 10; and the lower fixing members 305, the construction operation plates 4 and the joists 306 below the length regulating members 304 are removed as a whole; and step 5: after earth excavation of the foundation pit is performed to reach a predetermined elevation of a to-be-constructed lateral bracing on the next layer, step 3 and step 4 are repeated to achieve the construction of the lateral bracing on the next layer, wherein when the slings 303 are not long enough, lower ends of the slings 303 are connected with another sling 303 or more other slings 303 by the length regulating members 304; with the excavation of the foundation pit, a distance from the to-be-constructed lateral bracing to the first-layer lateral bracing member 2 gradually becomes far, so that the lengths of the slings 303 need to be increased constantly, the plurality of slings 303 may be spliced by virtue of the length regulating members 304 and/or lengthening members, and thus, the slings 303 and the upper fixing members 302 on the upper ends of the slings 303 do not need to be disassembled.

The present disclosure has the beneficial effects that:

1. by arranging the plurality of suspension rope systems on the first-layer lateral bracing member and laying the construction operation plates by virtue of the suspension rope systems, a safe, open and comfortable construction operation surface is provided for field construction personnel and supervisors; the construction device is suitable for the construction of a lateral bracing in a foundation pit which is large in excavation depth, low in silt bearing capacity and large in silt thickness, is particularly suitable for construction environments such as flow-plastic silt, silt reinforcement measure difficulty, short construction period and burdensome construction task, and compared with an existing construction device for a lateral bracing, the construction device effectively improves the construction quality of the lateral bracing in the foundation pit, greatly shortens the construction period and increases comprehensive benefits; and 2. the suspension rope systems are detachably connected with the construction operation plates, so that modular assembly and disassembly are achieved, the precamber of the lateral bracing is effectively controlled, the construction quality is improved, and the construction speed of the lateral bracing is increased; and the construction operation plates may be recycled, so that the construction cost is reduced.

Compared with one existing construction method for a lateral bracing in a foundation pit, the construction method provided by the present disclosure effectively improves the construction quality of the lateral bracing in the foundation pit, greatly shortens the construction period and increases comprehensive benefits. A safe, open and comfortable construction operation surface may be provided for field construction personnel and supervisors; and the construction method is suitable for the construction of a lateral bracing in a foundation pit which is large in excavation depth, low in silt bearing capacity and large in silt thickness, and is particularly suitable for construction environments such as flow-plastic silt, silt reinforcement measure difficulty, short construction period and burdensome construction task. A current construction method for a lateral bracing in an ultra-deep foundation pit with silt generally includes that: firstly, support frames/scaffolds are built layer by layer from top to bottom to provide an operation surface for construction; then, reinforcement cages of the lateral bracing are built; and finally, base plates and side formworks for pouring are laid for concrete pouring. After the construction is completed, the disassembly of the support frames in the foundation pits needs a great deal of manpower and seriously affects the construction period and the construction efficiency. By using the method provided by the present disclosure, not only is the provided construction operation surface safe and open, but also the construction operation surface and the base plates for pouring the reinforcement cages share the construction operation plates, base plate laying and removing processes in an existing method are omitted, and thus, the construction efficiency is further increased.

What is claimed is:

1. A construction method for a lateral bracing in an ultra-deep foundation pit with silt comprising steps of:

Step 1: constructing the enclosing structure in the foundation pit and the first-layer lateral bracing member;

Step 2: determining numbers and positions of the plurality of saddles according to a length of the first-layer lateral bracing member, and fixing the plurality of saddles to the first-layer lateral bracing member;

Step 3: providing diagonal bracings and determining positions of the diagonal bracings and length of the slings according to height of a to-be-constructed lateral bracing, and mounting the diagonal bracings on the enclosing structure; providing the construction operation plates with a length according to a length of the to-be-constructed lateral bracing, connecting the construction operation plates with the enclosing structure through the diagonal bracings, mounting the joists on the construction operation plates, and connecting the saddles and the joists through the slings;

Step 4: arranging reinforcements of the to-be-constructed lateral bracing on the construction operation plates, and binding the reinforcements to form reinforcement cages of the to-be-constructed lateral bracing; mounting side formworks on all side ends of the reinforcement cages to form a pouring cavity of the to-be-constructed lateral bracing; pouring concrete in the pouring cavity and removing the side formworks after a strength of the concrete reaches a standard or meets a design requirement, and thus, the construction of the lateral bracing on this layer is completed;

Step 5: repeating step 3 and step 4 to achieve construction of a lateral bracing on the next layer.

2. The construction method for the lateral bracing in the ultra-deep foundation pit with silt according to claim 1, wherein the connection between the slings and the joists is provided with length regulating members and lengthening members, the height and levelness of the construction operation plates are regulated by the regulating members or the lengthening members.

3. The construction method for the lateral bracing in the ultra-deep foundation pit with silt according to claim 2, wherein the suspension rope systems further comprise upper fixing members and lower fixing members; the upper fixing members are connected with the saddles; the lower fixing members are connected with the joists; upper ends of the slings are directly connected with the upper fixing members, or the upper ends of the slings are connected with the upper fixing members by the length regulating members; lower ends of the slings are connected with the lower fixing members by the length regulating members, or the lower ends of the slings are directly connected with the lower fixing members.

4. The construction method for the lateral bracing in the ultra-deep foundation pit with silt according to claim 1, wherein a connecting seam of the two adjacent construction operation plates is located at the upper end of the same joist.

5. The construction method for the lateral bracing in the ultra-deep foundation pit with silt according to claim 1, wherein the first-layer lateral bracing member comprising a reinforcement cage, angle steels and a concrete layer; the angle steels are connected with two sides of the enclosing structure; the reinforcement cage are connected with the angle steels; and the reinforcement cages are filled with the concrete layer.

* * * * *